US010589146B2

(12) United States Patent
Becker et al.

(10) Patent No.: US 10,589,146 B2
(45) Date of Patent: Mar. 17, 2020

(54) EXERCISE TREADMILL WITH SELECTABLE RUNNING SURFACE

(71) Applicants: Sara Becker, Brooklyn, NY (US); Ansgar Lorenz, Pacifica, CA (US)

(72) Inventors: Sara Becker, Brooklyn, NY (US); Ansgar Lorenz, Pacifica, CA (US)

( * ) Notice: Subject to any disclaimer, the term of this patent is extended or adjusted under 35 U.S.C. 154(b) by 177 days.

(21) Appl. No.: 15/599,749

(22) Filed: May 19, 2017

(65) Prior Publication Data

US 2017/0333748 A1 Nov. 23, 2017

Related U.S. Application Data

(60) Provisional application No. 62/338,913, filed on May 19, 2016.

(51) Int. Cl.

| | |
|---|---|
| ***A63B 22/02*** | (2006.01) |
| ***A63B 24/00*** | (2006.01) |
| ***A63B 71/06*** | (2006.01) |
| *A63B 21/008* | (2006.01) |

(52) U.S. Cl.

CPC ..... *A63B 22/0214* (2015.10); *A63B 22/0228* (2015.10); *A63B 22/0235* (2013.01); *A63B 22/0242* (2013.01); *A63B 24/0087* (2013.01); *A63B 71/0622* (2013.01); *A63B 21/00845* (2015.10); *A63B 2220/78* (2013.01); *A63B 2225/62* (2013.01)

(58) Field of Classification Search

CPC ..... A63B 21/00845; A63B 22/0214; A63B 22/0228; A63B 22/0235; A63B 22/0242; A63B 24/0087; A63B 71/0622; A63B 2220/78; A63B 2225/62

See application file for complete search history.

(56) References Cited

U.S. PATENT DOCUMENTS

| | | | | |
|---|---|---|---|---|
| 3,689,066 A * | 9/1972 | Hagen | A63B 22/02 198/811 |
| 4,616,822 A | 10/1986 | Trulaske et al. | |
| 5,279,528 A * | 1/1994 | Dalebout | A63B 22/0023 482/54 |
| 5,827,155 A * | 10/1998 | Jensen | A63B 22/02 482/54 |

(Continued)

OTHER PUBLICATIONS

Forbes, "If You're a Treadmill Fan, Your Favorite Indoor Workout Just Got Better," (Apr. 25, 2017).

*Primary Examiner* — Joshua Lee

(74) *Attorney, Agent, or Firm* — Law Office of Leo Zucker

(57) ABSTRACT

An exercise treadmill includes a frame, an endless belt, and a motor assembly for guiding the belt between front and rear ends of the frame while a user walks or runs on the belt. An impact absorbing assembly is supported beneath a region of the treadmill belt impacted by the user's feet when the user walks or runs on the belt. The assembly has physical properties that serve to define degrees of damping or springiness of the belt in the region impacted by the user. A control system including a user interface is coupled to the absorbing assembly, and the system is configured and operative to vary the physical properties of the assembly in response to an output from the user interface. The region of treadmill belt impacted by the user's feet then simulates a desired one of a number of different surfaces entered by the user on the interface.

3 Claims, 9 Drawing Sheets

(56) References Cited

U.S. PATENT DOCUMENTS 5,993,358 A * 11/1999 Gureghian ..... A63B 22/02 482/54
6,117,053 A * 9/2000 Chiu ..... A63B 22/02 482/51
6,174,267 B1 * 1/2001 Dalebout ..... A63B 22/02 482/51
7,563,203 B2 * 7/2009 Dalebout ..... A63B 22/02 482/51
7,563,205 B2 * 7/2009 Alling ..... A63B 22/0235 482/4
8,012,068 B1 * 9/2011 Malcolm ..... A63B 22/0235 482/54
8,435,160 B1 * 5/2013 Clum ..... A63B 22/02 482/54
9,352,186 B2 * 5/2016 Watterson ..... A63B 22/02
9,573,017 B2 * 2/2017 Chang ..... A63B 22/0214
2004/0058786 A1 * 3/2004 Nerio ..... A63B 21/00 482/54
2004/0242378 A1 12/2004 Pan et al.
2006/0205568 A1 * 9/2006 Huang ..... A63B 22/02 482/54
2007/0049465 A1 * 3/2007 Wu ..... A63B 22/0235 482/54
2009/0181829 A1 * 7/2009 Wu ..... A63B 22/02 482/54
2013/0130868 A1 * 5/2013 Hou ..... A63B 22/02 482/54
2013/0130869 A1 * 5/2013 Hou ..... A63B 22/02 482/54
2013/0203562 A1 8/2013 Clum et al.
2016/0045781 A1 2/2016 Chang
2017/0136290 A1 5/2017 Cei

* cited by examiner

EXERCISE TREADMILL WITH SELECTABLE RUNNING SURFACE

CROSS REFERENCE TO RELATED APPLICATION

This application claims priority under 35 U.S.C. § 119(e) of Provisional Patent Application No. 62/338,913 filed May 19, 2016, titled "Exercise Treadmill With User Selectable Running Surface," the entire contents of which are incorporated by reference.

BACKGROUND OF THE INVENTION

Field of the Invention

The present invention concerns exercise treadmills, particularly treadmills constructed to absorb the impact of a user's feet.

Discussion of the Known Art

Exercise treadmills constructed to absorb the impact of a user's feet on the treadmill belt as the user walks or runs on the belt, are generally known. For example, see U.S. Pat. No. 4,616,822 (Oct. 14, 1986); and U.S. Patent Application Pubs. No. 2004/0242378 (Dec. 2, 2004); No. 2013/0203562 (Aug. 8, 2013); and No. 2016/0045781 (Feb. 18, 2016), all of which are incorporated by reference.

Notwithstanding the known art, there is a need for an exercise treadmill that allows the user to experience a desired "feel" in terms of the degree of springiness and/or damping in the area of the treadmill belt impacted by the user's feet. Specifically, there is a need for a treadmill wherein the user can alter the physical response of the treadmill belt to his or her feet in such a way as to simulate a walk or run on a desired one of multiple running surfaces, for example, grass, sand, and dirt.

SUMMARY OF THE INVENTION

According to the invention, an exercise treadmill includes a frame and an endless treadmill belt. A motor assembly is supported by the frame and operates to guide the treadmill belt to travel between front and rear ends of the frame while a user's feet impact a certain region of the belt when the user walks or runs on the belt.

An impact absorbing assembly is supported by the frame beneath the region of the treadmill belt impacted by the user's feet, and the assembly has physical properties that serve to define degrees of damping or springiness of the belt in the region of the belt impacted by the user's feet.

A control system including a user interface is coupled to the impact absorbing assembly, and the control system is configured and operative to vary the physical properties of the assembly in response to an output from the user interface. The region of treadmill belt impacted by the user's feet will then simulate a desired one of a number of different surfaces that may be selected by the user on the interface.

For a better understanding of the invention, reference is made to the following description taken in conjunction with the accompanying drawing and the appended claims.

BRIEF DESCRIPTION OF THE DRAWING FIGURES

DETAILED DESCRIPTION OF THE INVENTION

Various embodiments of an exercise treadmill according to the invention are illustrated in the accompanying drawing figures and are detailed below. Assume for example a user desires to run on sand, but the nearest beach is too far away for a casual run. The embodiments disclosed herein will allow the user to choose from among a "Sand," a "Dirt," and other modes of operation in which the treadmill belt simulates a desired running surface. If the user selects "Sand," components supported below the area of the treadmill belt impacted by the user's feet are controlled to adjust their physical properties to provide the user with the sensation of walking or running on sand. If the user later selects a "Dirt" mode, the properties of the components beneath the belt are re-adjusted to simulate the feel of running on dirt by, for example, increasing the degree of cushioning or shock absorption for the user from the feet on up.

Figure 1A:
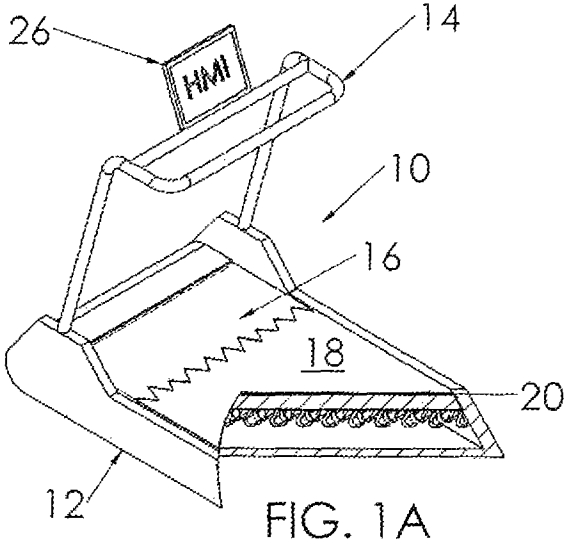
FIGS. 1A to 1C are views of a first embodiment of an exercise treadmill according to the invention.
Figure 1B:
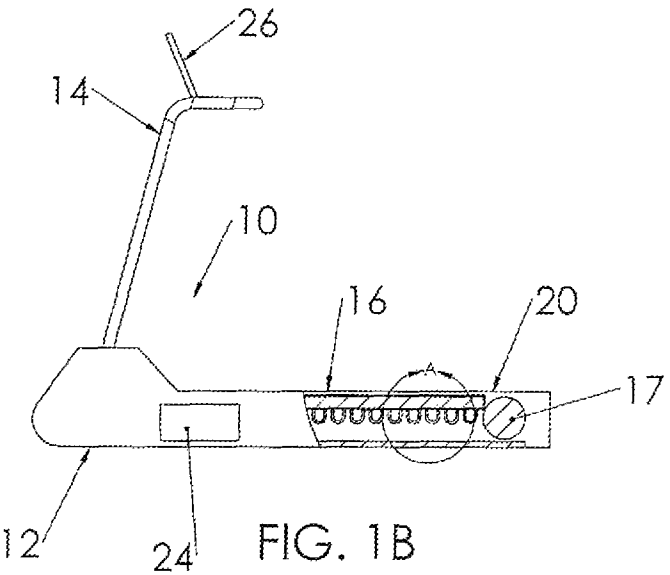
Figure 1C:
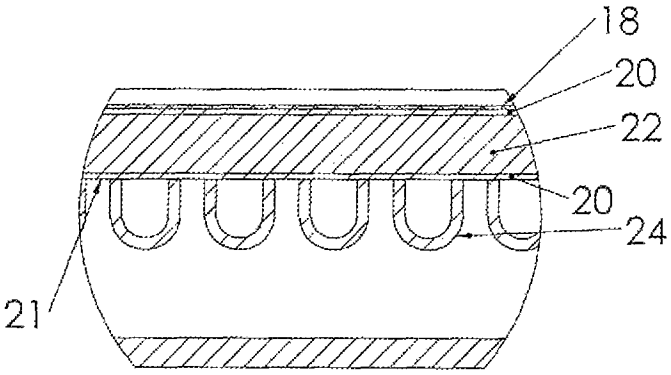

Magnetic Sand (FIGS. 1A to 1C)

FIG. 1A is a perspective view of a forward portion of an exercise treadmill 10 according to the invention. The treadmill 10 includes a generally rectangular structural frame 12. An elevated hand bar 14 may be secured to the frame 12 at a front end of the treadmill for holding during use. FIG. 1B is a side view of the treadmill 10, partly in cross section.

The treadmill 10 also has an endless belt 16 that is driven by a conventional variable speed motor assembly, wherein the belt is guided to travel around rollers 17 at opposite ends of the frame 12, and at a speed that may be adjusted by the user. A portion of the belt 16 is broken away in FIG. 1A to show a sheet 18 that is disposed on a top surface of a flexible rubber casing 20, so that the belt 16 slides directly over the sheet 18 during operation of the treadmill 10. The sheet 18 may comprise a low friction material such as, e.g., PTFE, PET, graphite, or other lubricious material capable of remaining in direct contact with the underside of the belt 16 without overheating while the belt is driven to slide continuously over the sheet 18 and the user's feet impact on the belt repeatedly.

The casing 20 is fixed within the structural frame 12 of the treadmill as shown in FIGS. 1A and 1B. Details of the casing 20 are shown in FIG. 1C. Contained in the casing 20 are ferromagnetic spheroids, beads, powder, or other small fine grains or granules 22. As mentioned, the casing 20 and the top sheet 18 remain stationary and fixed with respect to the treadmill frame 12 while the belt 16 slides over sheet 18 and the user walks or runs on the belt.

A grid of electromagnets 24 are arranged in close proximity to the casing 20. For example, all or portions of the electromagnets 24 may project from a bottom surface 21 of the casing 20 as in FIG. 1C. The electromagnets 24 need not be horseshoe shaped as shown, e.g., they can be in the form of bobbin wound cylindrical core magnets.

When an electric current is supplied to the electromagnets 24, a magnetic field is produced which interacts with the ferromagnetic granules 22 inside the casing 20, and causes the granules 22 to attract one another with magnetic force. As a result, the granules collectively acquire a stiffness within the casing 20 that is proportional to the strength of the magnetic field produced by the electromagnets 24. The strength of the magnetic field in turn is proportional to the current suppled to the electromagnets. If no current is supplied and no magnetic field is produced, the granules 22 will exhibit minimal, if any, damping or spring characteristics within the casing 20.

The inventive treadmill 10 therefore includes a conventional control module for adjusting the strength of electric current to be supplied to the electromagnets 24, and an associated user interface 26 mounted, e.g., on the hand bar 14 of the treadmill for convenient access by a user. By adjusting the strength of the electric current via the interface 26, the user can cause the granules 22 in the casing 20 to exhibit a degree of stiffness or damping that simulates a desired running surface as the belt runs over the casing 20 and the user's feet repeatedly impact the belt 16.

Air Bag Suspension (FIGS. 2A to 2E)

Figure 2A:
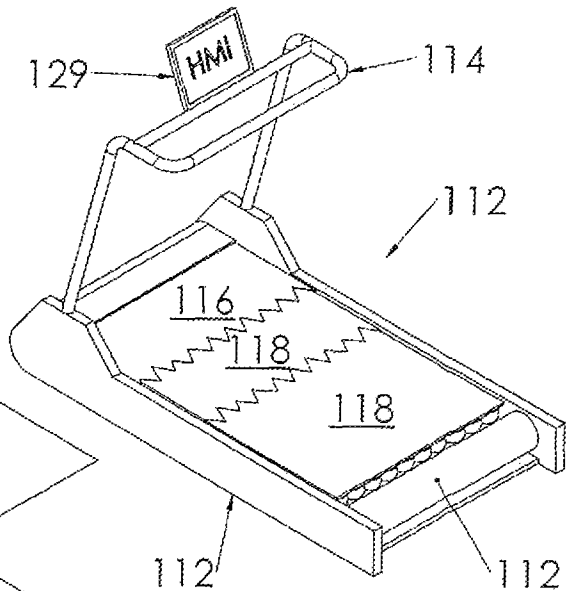
FIGS. 2A to 2E are views of a second embodiment of an exercise treadmill according to the invention.

FIG. 2A is a perspective view of a second embodiment of an exercise treadmill 110 according to the invention. The treadmill 110 includes a generally rectangular structural frame 112. An elevated hand bar 114 may be secured to the frame 112 at a front end of the treadmill 110 for holding during use. FIG. 2B is a side view of the treadmill 110, partly in cross section.

The treadmill 110 also has an endless belt 116 that is driven by a conventional variable speed motor assembly, wherein the belt is guided to travel around rollers 117 at opposite ends of the frame 112, and at a speed that may be adjusted by the user. A portion of the belt 116 is broken away in FIG. 2A to show a top surface of a flexible sheet 118 of low friction material, e.g., PTFE, PET, graphite or other lubricious material capable of maintaining direct contact with the belt 116 without overheating as the belt runs continuously over the sheet 118 and the user's feet impact the belt repeatedly.

Figure 2C:
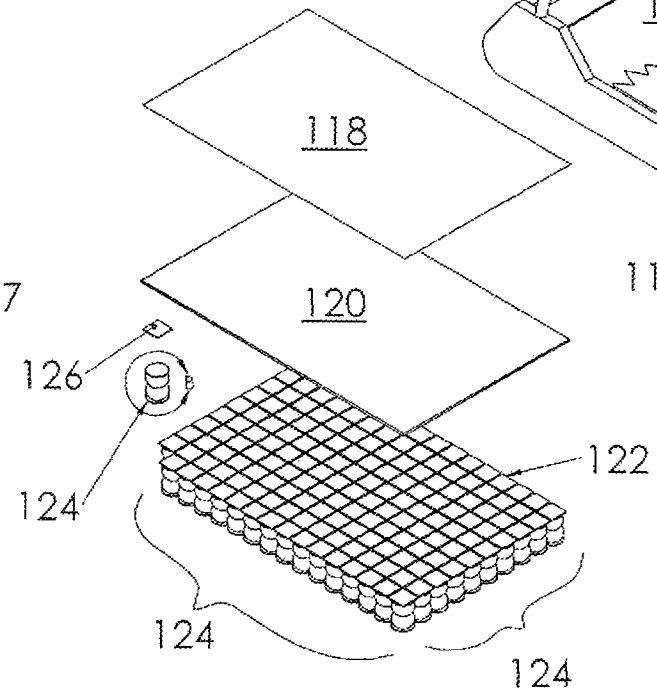
Figure 2B:
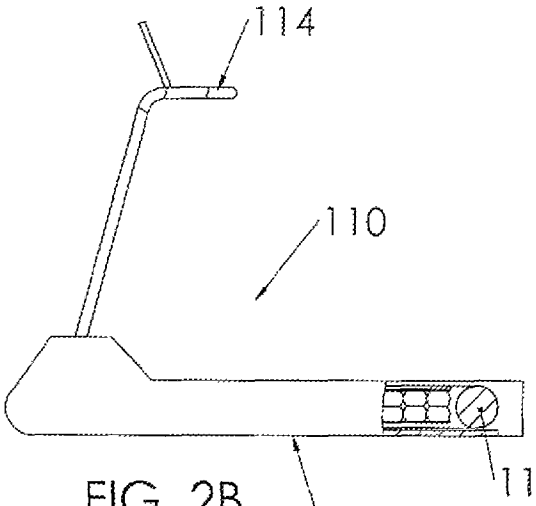
Figure 2D:
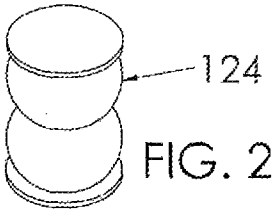

As shown in FIG. 2C, a flexible foam or rubber sheet 120 is disposed between the sheet 118 and the top surface of an array or grid 122 of conventional, inflatable elastic air bags 124. One of the air bags 124 is shown in FIG. 2D. The air bags 124 may be the same as or similar to air/gas inflatable bags of the kind used in tractor trailers, hot rods, and other vehicles having adjustable air/gas bag suspensions. A square puck or block 126 of stiff plastics or composite material is preferably disposed between the top of each bag 124 and the underside of the flexible sheet 120 on top of the air bag array 122.

Figure 2E:
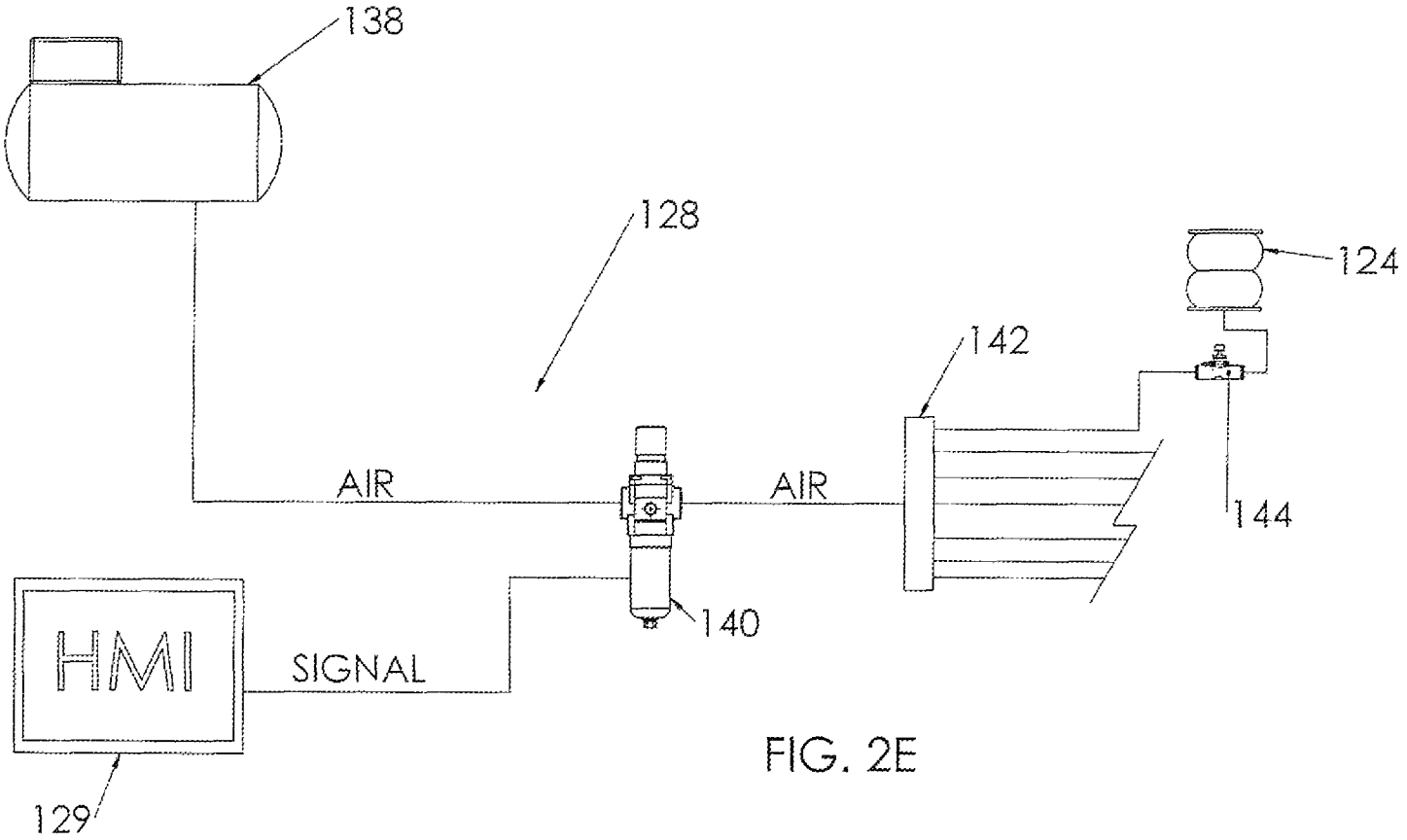

A pneumatic control system 128, shown in FIG. 2E, is mounted on or supported within the treadmill 110. An associated human machine interface (HMI) 129 is mounted for convenient access by a user, e.g., on the hand bar 114 in FIG. 2A. The control system 128 enables a user to simulate a desired running surface on the treadmill belt 116 by controlling the degree to which the bags 124 are inflated, thereby adjusting the overall springing and damping properties of the air bag array 122 beneath the belt 116 accordingly.

In the control system 128, air (or other inert gas) originating from a compressor 138 is communicated through an adjustable pressure regulator 140 to an air manifold 142. The HMI 129 is coupled to the regulator 140 to enable the user to control the air pressure inside the bags 124 of the air bag array 122. Each air bag 124 of the array 122 is connected to a manifold 142 through an associated check valve 144. The valves 144 allows full and unrestricted air flow into the bags 124, but restrict or check any flow of air out of each bag, so that a constant pressure and height are maintained for all of the air bags 124, notwithstanding that the user's weight is typically concentrated in a small area of the treadmill belt 116 where the belt overlies the air bag array 122. An air pressure of about 10 PSIG to about 120 PSIG, depending on the material and the size of the air bags 124 and other pressurized components in the inventive treadmill detailed below, should be available in order to simulate various types of running surfaces on the treadmill belt 116.

Figure 3A:
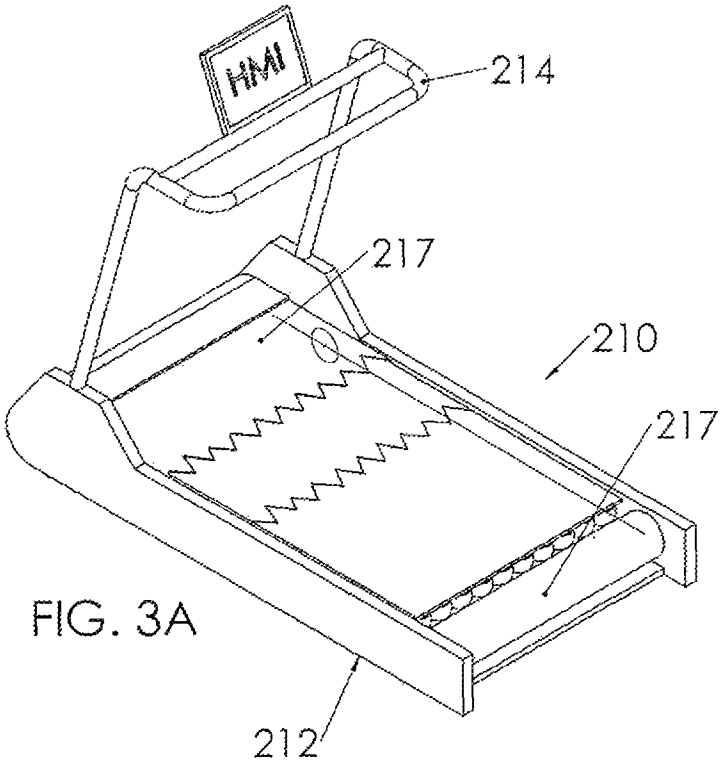
FIGS. 3A to 3C are views of a third embodiment of an exercise treadmill according to the invention.
Figure 3B:
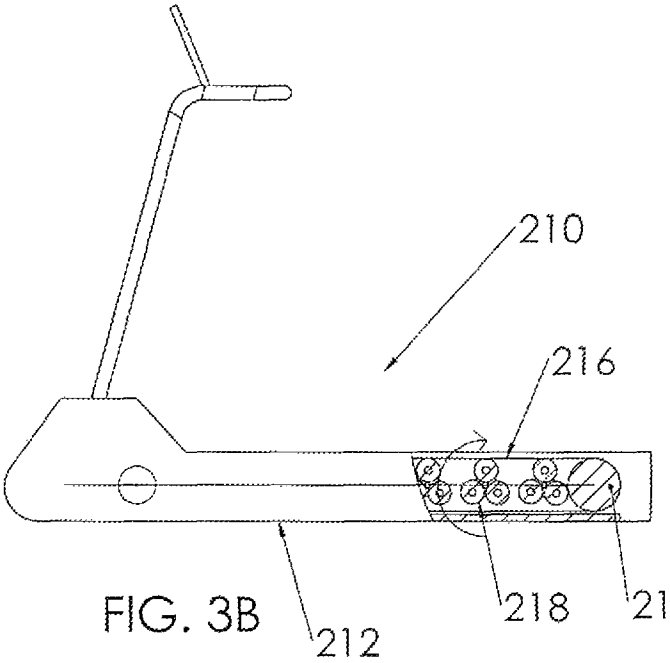
Figure 3C:
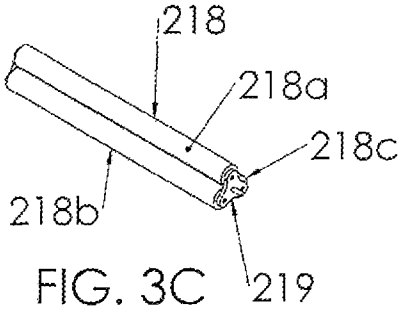

Frame and Rollers (FIGS. 3A to 3C)

FIG. 3A is a perspective view of a third embodiment of an exercise treadmill 210 according to the invention. The treadmill 210 includes a generally rectangular structural frame 212. An elevated hand bar 214 may be secured to the frame 212 at a front end of the treadmill 210 to hold during use. FIG. 3B is a side view of the treadmill 210, partly in cross section.

The treadmill 210 also has an endless belt 216 that is driven by a conventional variable speed motor assembly, wherein the belt is guided to travel around rollers 217 at opposite ends of the frame 212, and at a speed that may be adjusted by the user. The treadmill belt 216 is omitted in FIG. 3A in order to show a number of elongated roller carriages 218 mounted on the frame 112 closely parallel to one another and in a common plane beneath the upper stretch of the belt 216. As seen in FIG. 3C, each carriage 218 includes a set of, for example, three rollers 218*a*, 218*b*, 218*c*, each of which has an outside foam or elastic layer of a different density that exhibits a corresponding spring or damping coefficient. The ends of the rollers 218*a*-218*c* of each carriage 218 are pivoted in corresponding end brackets 219, and the end brackets 219 of each carriage are aligned within the sides of the treadmill frame 212. With the rollers 218*a*-218*c* of each carriage at the same angular position relative to one another, the brackets 219 are linked to one another by, e.g., a common chain, belt, or other device to enable the carriages 218 to be rotated in synch with one another.

Accordingly, a desired degree of springiness and damping in the region of the belt 216 impacted by the user's feet can be obtained by rotating the carriages 218 via the common linking device, until each carriage 218 positions the roller corresponding to the desired spring or damping coefficient directly beneath the belt 216. The desired running surface is then simulated over the region of the belt impacted by the user's feet.

Figure 4A:
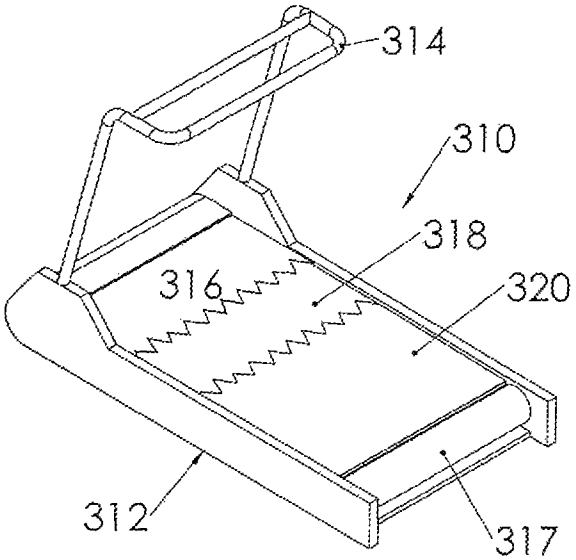
FIGS. 4A to 4C are views of a fourth embodiment of an exercise treadmill according to the invention.
Figure 4B:
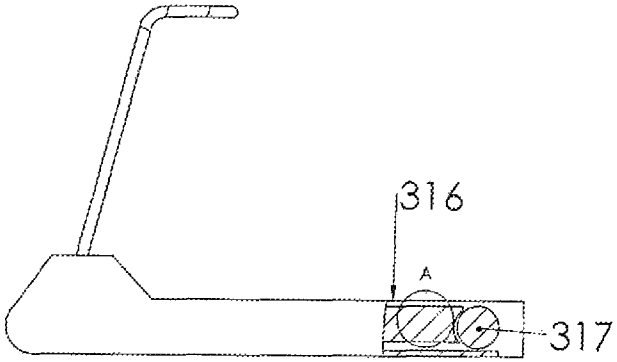
Figure 4C:
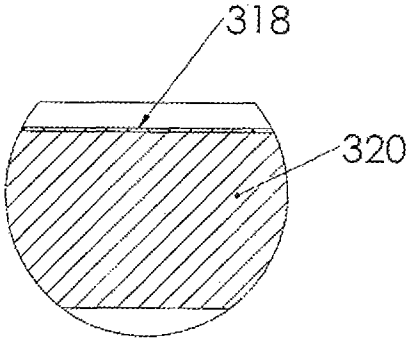

PVDF Cross-Linked Foam Bed (FIGS. 4A to 4C)

FIG. 4A is a perspective view of a fourth embodiment of an exercise treadmill 310 according to the invention. The treadmill 310 includes a generally rectangular structural frame 312. An elevated hand bar 314 may be secured to the frame 312 at a front end of the treadmill 310 to hold during use. FIG. 4B is a side view of the treadmill 310, partly in cross section.

The treadmill 310 also has an endless belt 316 that is driven by a conventional motor assembly so that the belt is guided to travel around rollers 317 at opposite ends of the frame 312, and at a speed that may be adjusted by the user. A portion of the treadmill belt 316 is broken away in FIG. 4A to show a flexible sheet 318 of low friction material, e.g., PTFE, PET, graphite or other lubricious material capable of maintaining direct contact with the belt 316 without overheating while the belt runs continuously over the sheet 318 and the user's feet repeatedly impact the belt.

A block 320 of polyvinylidene fluoride (PVDF), which is a non-reactive and thermoplastic fluoropolymer commercially available under the mark Kynar®, is supported by the frame 312 and arranged as a bed directly beneath the flexible sheet 318. The block 320 has piezoelectric properties that cause it to change in shape and/or stiffness in response to an applied electric field or voltage.

An adjustable electrical field or potential is applied to the block 320 in a known manner by appropriate coupling devices and an associated power supply within the treadmill 310 under the control of the user. Accordingly, the springiness and/or damping properties of the block 320 can be adjusted by the user to simulate a desired running surface in the region of the belt 316 impacted by the user's feet.

Magnetorheological Fluid Suspension (FIGS. 5A to 5D)

Figure 5A:
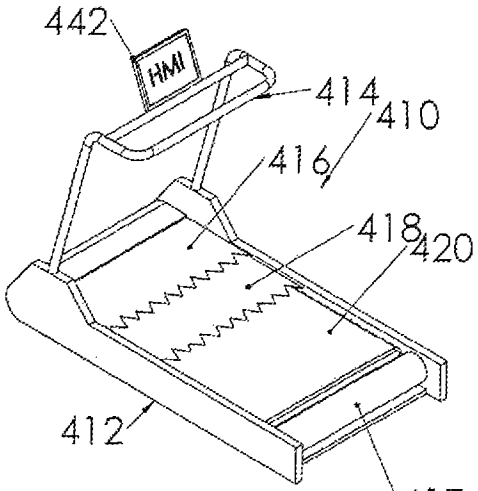
FIGS. 5A to 5D are views of a fifth embodiment of an exercise treadmill according to the invention.
Figure 5B:
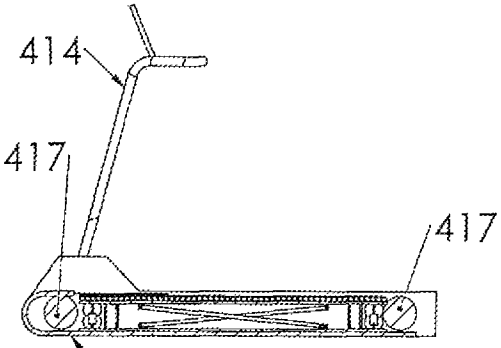

FIG. 5A is a perspective view of a fifth embodiment of an exercise treadmill 410 according to the invention. The treadmill 410 includes a generally rectangular structural frame 412. An elevated hand bar 414 may be secured to the frame 412 at a front end of the treadmill 410 to hold during use. FIG. 5B is a side view of the treadmill 410, partly in cross section.

The treadmill 410 also has an endless belt 416 that is driven by a conventional motor assembly so that the belt 416 is guided to travel around rollers 417 at opposite ends of the frame 412, and at a speed that may be adjusted by the user. A portion of the treadmill belt 416 is broken away in FIG. 5A to show a flexible top sheet 418 of low friction material, e.g., PTFE, PET, graphite or other lubricious material capable of maintaining direct contact with the underside of the belt 416 without overheating as the belt runs continuously over the top sheet 418 and the user's feet impact the belt during use. A soft elastomeric coil of rubber or plastics hose or tubing in the form of a sheet 420 is disposed beneath the top sheet 418, and a rig id top plate 422 is disposed beneath the sheet 420. The sheet 420 acts as a first contact surface that provides the user with an initial give or springiness on the treadmill belt 416, and the sheet 420 acts to give the belt 416 the "feel" of a running surface. Suspension components below the sheet 420 and detailed below serve to absorb impact loading from the up and down motion of the user on the belt 416. That is, the sheet 420 provides an immediate feel under foot, and the components below the sheet 420 lessen shock to the user's joints as well as complement the entire feel of a walk or run on the treadmill 410 by the user.

The top plate 422 is suspended at its corners by four fluid shock absorbers 426 above a rigid base plate 424. The shock absorbers contain a magnetorheological (MR) fluid which is a type of "smart" fluid embodied within, e.g., an oil. MR fluid increases its apparent viscosity when subjected to a magnetic field. Thus, the degree of damping provided by the shock absorbers 426 to the top plate 422 can be controlled accurately by varying the intensity of a magnetic field produced by electromagnets within the shock absorbers. Four inflatable air bags 428 are also provided between the base plate 424 and corers of the top plate 422, so that the springiness provided by the air bags to the top plate 422 can be controlled by varying the degree to which the air bags are inflated.

Figure 5C:
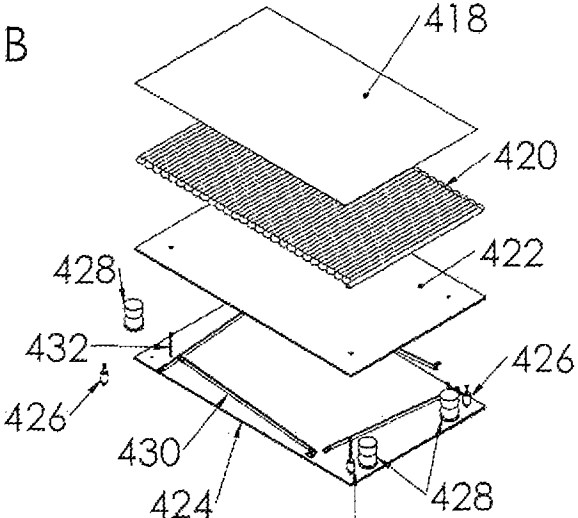

To keep the top plate 422 level and parallel to the base plate 424, the top plate may be linked to the base plate by four rigid rods 430 each of which is pivoted at one end to a corner of the top plate, and at the opposite end to a corner of the base plate 424 as shown in FIG. 5C. A length of flexible wire rope 432 is fixed at each end to the top plate 422 and to the base plate 424 by, e.g., retaining the ends of the rope in holes drilled in each plate. Thus, when the air bags 428 are pressurized and start to increase in height, the rope 432 will limit and maintain the height of the top plate 422 at a desired level.

Figure 5D:
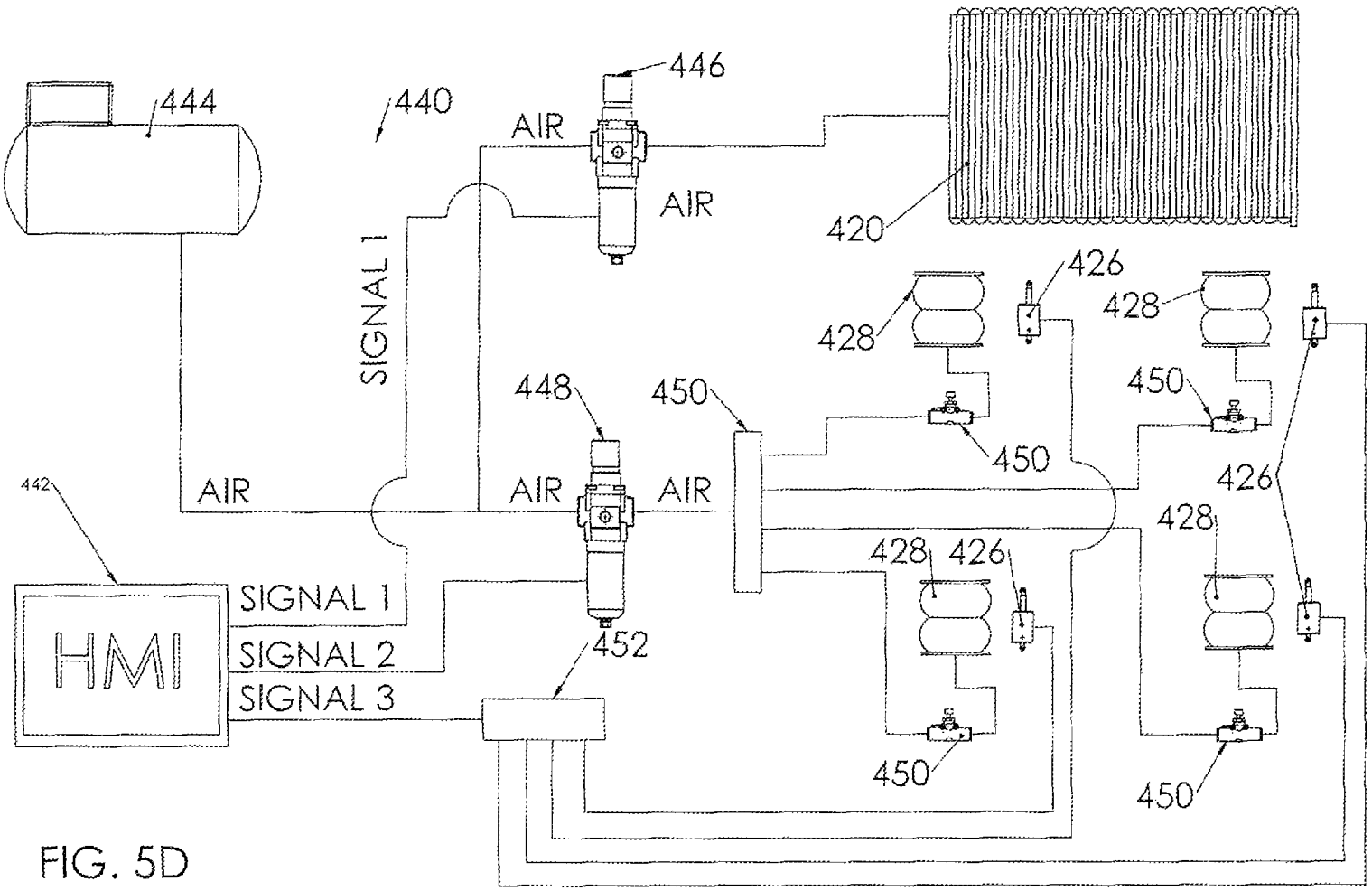

FIG. 5D is a schematic block diagram of a control system 440 for the treadmill 410. The control system 440 is mounted on or supported within the treadmill 410. An associated human machine interface (HMI) 442 is mounted for convenient access by a user, e.g., on the hand bar 414 in FIG. 5A. The control system 440 enables the user to simulate a desired running surface on the treadmill belt 416 by controlling the degree to which the viscosity of their MR fluid is increased, and by controlling the degree to which the air bags 428 are inflated.

In the control system 440, air (or other inert gas) originating from a compressor 444 is communicated through a first electronically controlled air pressure regulator 446 to the elastomeric sheet 420. Air from compressor 444 is also communicated through a second electronically controlled air pressure regulator 448 to an input port of an air manifold 450. The pressure of air supplied from each of the regulators 446 and 448 is controlled by corresponding signals from the HMI 442.

Specifically, pressurized air is communicated to each one of the air bags 428 from a corresponding output port of the air manifold 450 and through an adjustable control valve 451. Each control valve 451 has an internal check valve to allow unrestricted air flow into the associated air bag 428 to obtain a desired degree of inflation, i.e., springiness of the air bags 428, and to restrict air flow out of the bags. The HMI 442 is also coupled to a shock absorber controller 452 that produces output signals for input to each of the shock absorbers 426 to obtain a desired degree of damping for the shock absorbers.

To reduce manufacturing costs, the MR fluid shock absorbers 426 may be omitted, leaving only the air bags 428 to provide an adjustable degree of springiness beneath the treadmill belt 416, in addition to a certain fixed amount of damping provided by the elastomeric sheet 420

Air Springs or Cylinders (FIGS. 6A to 6D)

Figure 6A:
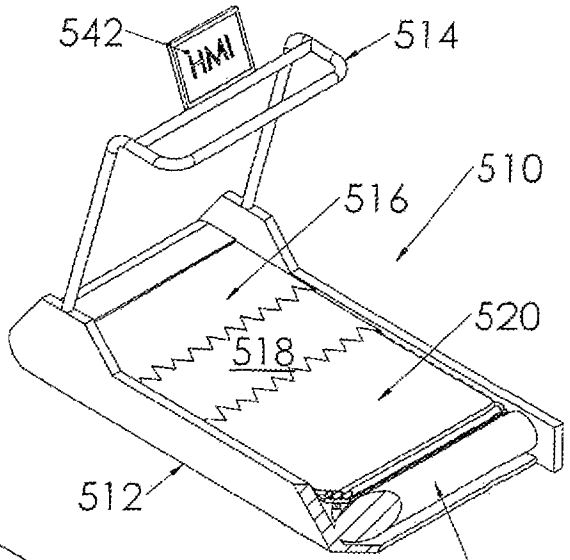
FIGS. 6A to 6D are views of a sixth embodiment of an exercise treadmill according to the invention.
Figure 6B:
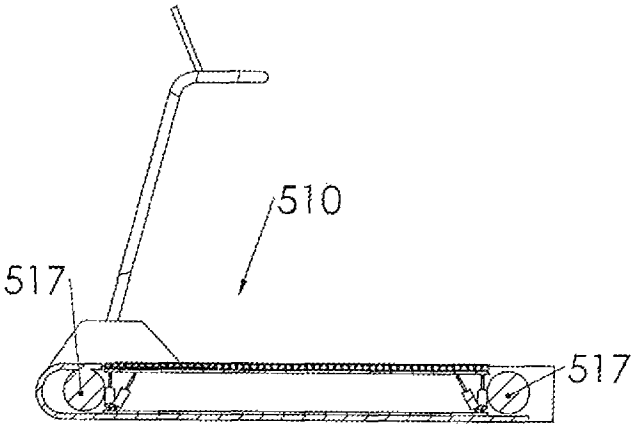
Figure 6C:
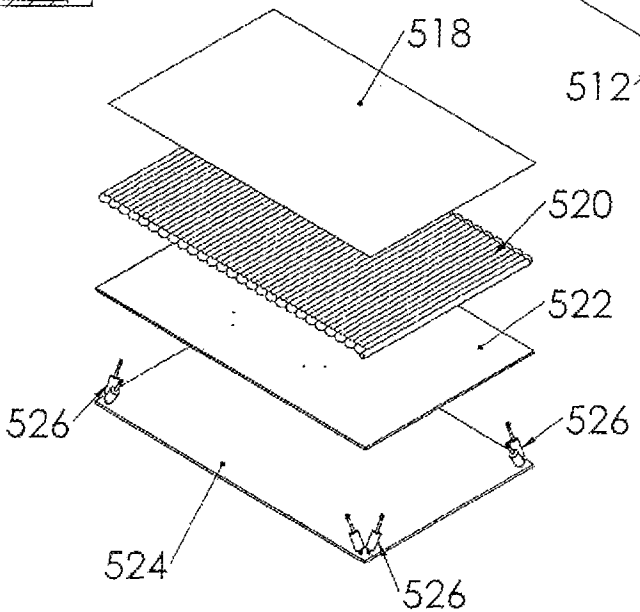

FIG. 6A is a perspective view of a sixth embodiment of an exercise treadmill 510 according to the invention. The treadmill 510 includes a generally rectangular structural frame 512. An elevated hand bar 514 may be secured to the frame 512 at a front end of the treadmill 510 to hold during use. FIG. 6B is a side view of the treadmill 510 in cross section.

The treadmill 510 also has an endless belt 516 that is driven by a conventional motor assembly so that the belt 516 is guided to travel around rollers 517 at opposite ends of the frame 512, and at a speed that may be adjusted by the user. A portion of the treadmill belt 516 is broken away in FIG. 6A to show a flexible top sheet 518 of low friction material, e.g., PTFE, PET, graphite or other lubricious material capable of maintaining direct contact with the underside of the belt 516 without overheating as the belt runs continuously over the top sheet 518 and the user's feet impact the belt 516 during use. A soft elastomeric rubber or plastics hose or tubing in the form of a sheet 520 is disposed beneath the top sheet 518, and a rig id top plate 522 is disposed beneath the sheet 520.

The top plate 522 is suspended at each of its four corners by a pair of air springs or cylinders 526, above a rigid base plate 524. See FIG. 6C. Note that the air springs 526 are arranged at angles that are not perpendicular to either the base plate 524 or the top plate 522. Accordingly, the sides of the top plate 522 absorb impact forces not only in the vertical direction, but also absorb any horizontal forces transmitted to the top plate from the treadmill belt 516.

Figure 6D:
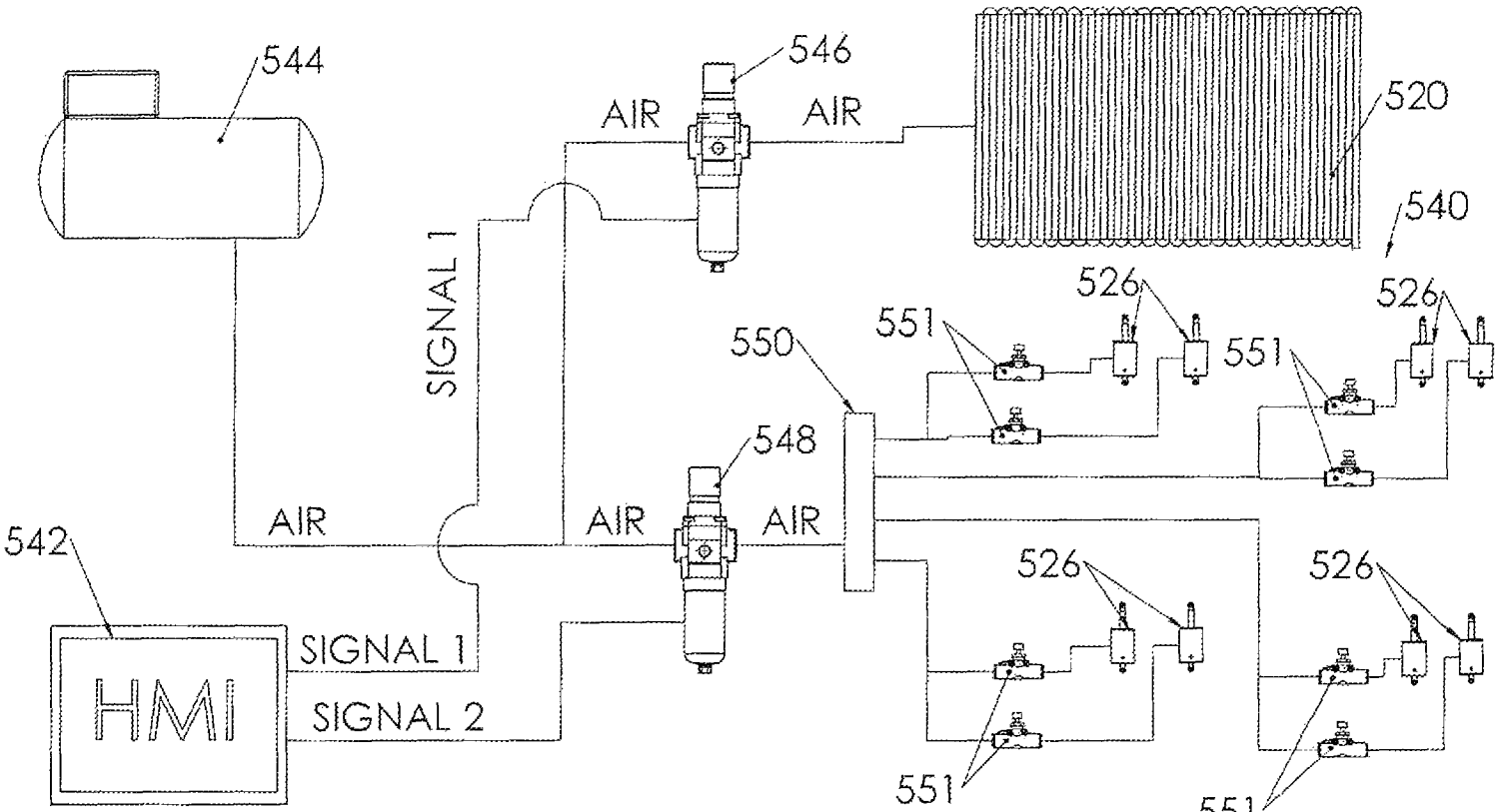

FIG. 6D is a schematic block diagram of a control system 540 for the treadmill 510. The control system 540 is mounted on or supported within the treadmill 510. An associated human machine interface (HMI) 542 is mounted for convenient access by a user, e.g., on the hand bar 514 in FIG. 6A. The control system 540 enables the user to simulate a desired running surface on the treadmill belt 516 by controlling the degree to which the air springs 526 are pressurized.

In the control system 540, air (or other inert gas) originating from a compressor 544 is communicated through a first electronically controlled air pressure regulator 546 to the elastomeric sheet 520. Air from compressor 544 is also communicated through a second electronically controlled air pressure regulator 548 to an input port of an air manifold 550. The pressure of air supplied from each of the regulators 546 and 548 is controlled by corresponding signals from the HMI 542.

Specifically, pressurized air is communicated to each pair of air springs 526 from a corresponding output port of the air manifold 550, and through a pair of adjustable control valves 551. Each control valve 551 has an internal check valve to allow unrestricted air flow into the associated spring 526 to obtain a desired degree of springiness, and to restrict air flow out of the springs.

In use, a person enters a desired surface characteristic for the treadmill belt 516 from among a number of different choices on the interface 542. The interface 542 is programmed and configured to produce output signals corresponding to the degree of damping and springiness required for the belt 516 to simulate the desired surface characteristic. The output signals from the interface 542 are simultaneously input to the pressure regulator 546 associated with the inflatable sheet 520, and the pressure regulator 548 associated with the air springs 526. The desired surface characteristic is then simulated in the region of the treadmill belt 516 on which the user may walk or run.

While the foregoing represents preferred embodiments of the invention, it will be understood by those skilled in the art that various modifications, adaptations, and additions may be made without departing from the spirit and scope of the invention, and that the invention includes all such modifications, adaptations, and additions as are within the scope of the following claims.

We claim:

1. An exercise treadmill, comprising:

an elongated frame;

a treadmill belt;

a motor assembly supported by the frame and operative to guide the treadmill belt to travel between front and rear ends of the frame while a user's feet impact a certain region of the belt when the user walks or runs on the belt;

an impact absorbing assembly supported by the frame beneath the region of the treadmill belt impacted by the user's feet when the user walks or runs on the belt, and the assembly has physical properties that serve to define degrees of damping or springiness of the belt in said region; and a control system coupled to the impact absorbing assembly and including a user interface, wherein the control system is configured and operative to vary the physical properties of the impact absorbing assembly in response to an output from the user interface, and the region of the treadmill belt impacted by the user's feet simulates a desired one of a number of different surfaces entered by the user on the interface;

the impact absorbing assembly comprises a number of elongated air springs or cylinders, a top plate and a base plate, and the top plate is suspended above the base plate at each corner of the top plate by a pair of the air springs or cylinders; and wherein each pair of air springs or cylinders are angularly offset from perpendicular to either the base plate or the top plate, so that sides of the top plate absorb impact forces transmitted to the top plate from the treadmill belt in both vertical and horizontal directions.

2. The exercise treadmill according to claim 1, wherein the impact absorbing assembly comprises a flexible sheet of a relatively low friction material supported beneath the treadmill belt for direct contact with the belt as the belt runs over the assembly.

3. The exercise treadmill according to claim 1, wherein the impact absorbing assembly comprises at least one air pressure regulator.

* * * * *